United States Patent [19]

Erickson et al.

[11] 4,342,373

[45] Aug. 3, 1982

[54] MUFFLER WITH THREE PART WELDED JOINT

[75] Inventors: Ernest A. Erickson, Sturtevant, Wis.; Rodger D. Hanson, Jackson; Lance D. Mews, Clark Lake, both of Mich.

[73] Assignee: Tenneco Inc., Deerfield, Ill.

[21] Appl. No.: 244,694

[22] Filed: Mar. 17, 1981

[51] Int. Cl.[3] ..... F01N 1/08; B23K 31/02; F16L 13/02

[52] U.S. Cl. ..... 181/266; 181/264; 219/59.1; 219/107; 228/173 C; 228/182; 285/286

[58] Field of Search ..... 181/249–250, 181/264–266, 268–269, 272–273, 275–276; 219/59.1, 101, 107; 228/173 B, 173 C, 173 F, 182; 285/286, 416; 403/271, 272

[56] References Cited

U.S. PATENT DOCUMENTS

| | | | |
|---|---|---|---|
| 3,557,904 | 1/1971 | Grote | 181/266 |
| 3,882,299 | 5/1975 | Sciaky | 219/101 X |
| 4,109,755 | 8/1978 | Grueneberg | 181/266 |

*Primary Examiner*—L. T. Hix
*Assistant Examiner*—Thomas H. Tarcza
*Attorney, Agent, or Firm*—Harness, Dickey & Pierce

[57] ABSTRACT

An automotive type internal combustion engine exhaust muffler has a welded butt joint consisting of the ends of a pipe bushing, a lockseam louver tube, and a partition neck into which the tube is pressed, the welded joint preferably being of a structure produced by the magnet arc process.

5 Claims, 6 Drawing Figures

FIG. 3.
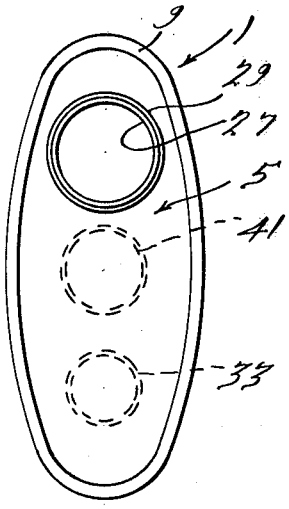
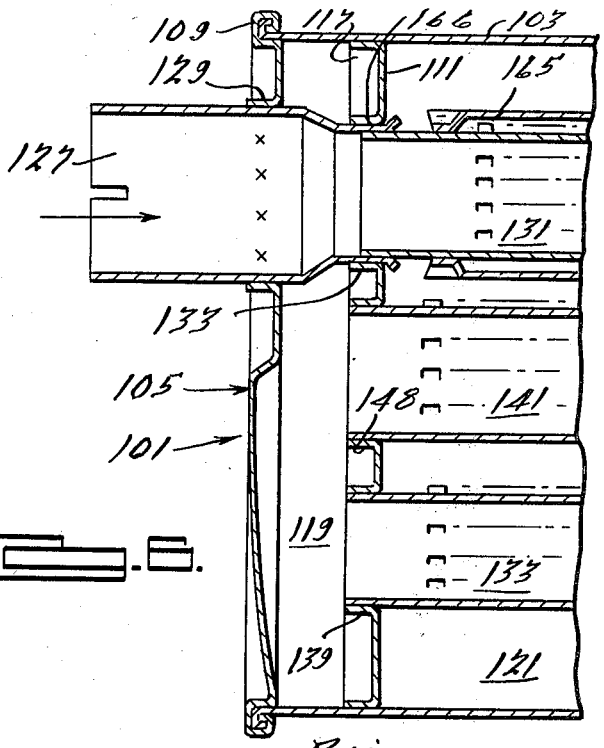
FIG. 6.
Prior Art
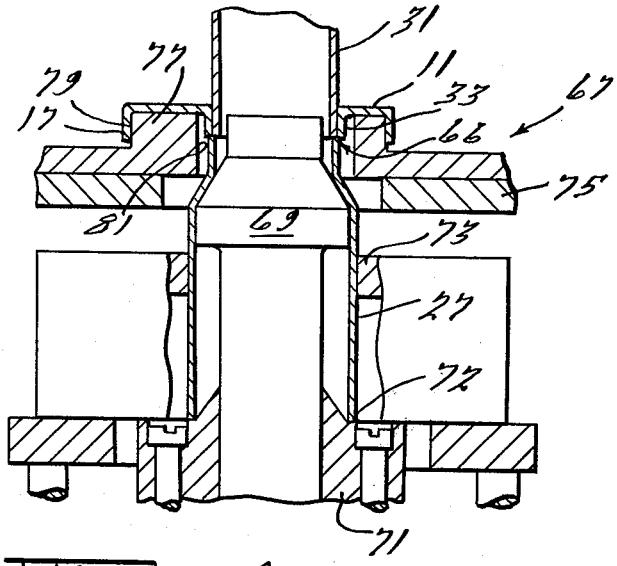
FIG. 4.
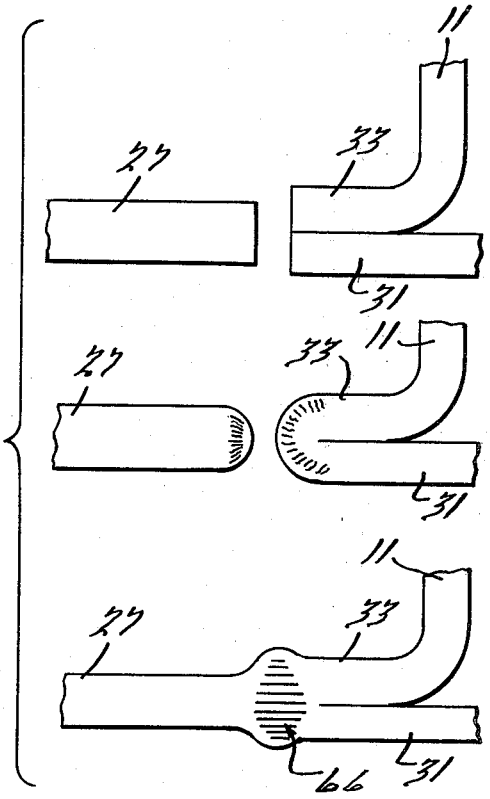
FIG. 5.

MUFFLER WITH THREE PART WELDED JOINT

BRIEF SUMMARY OF THE INVENTION

It is the purpose of the invention to improve the construction of acoustic mufflers used in the exhaust systems of motor vehicles having internal combustion engines or the equivalent. More particluarly, it is a purpose of the invention to reduce the amount of metal used in exhaust mufflers, and thereby reduce their weight, without adversely affecting their strength or performance.

The invention achieves this purpose by means of a novel three part butt joint wherein the ends of two tubular parts are welded to each other and to the end of a neck in a partition. In a preferred form, one of the tubular parts is an inlet or outlet bushing that is also welded to an end header and another tubular part is a lockseam louver tube pressed into the partition neck.

The joint of this invention eliminates metal overlap of one of the tubular parts with the partition neck. Since the joint of this invention is usable in the production of millions of mufflers the saving in metal and weight and therefore fuel is very substantial and significant. The joint can be produced at a cost comparable to of less than that of prior joints used for the same parts.

DESCRIPTION OF THE DRAWINGS

FIG. 3 is an end elevation taken from the left of FIG. 1 and is shown on a reduced scale;

FIG. 4 is a somewhat schematic view showing assembly and welding of the joint of FIGS. 1 and 2;

FIG. 5 is a schematic view showing stages in the formation of the joint;

FIG. 6 is a broken away cross section similar to the left end of FIG. 1 showing prior art which the present joint is intended to replace. In this Figure parts corresponding to those in FIGS. 1 and 3 have 100 added to the reference numbers of FIGS. 1 and 3.

Figure 1:
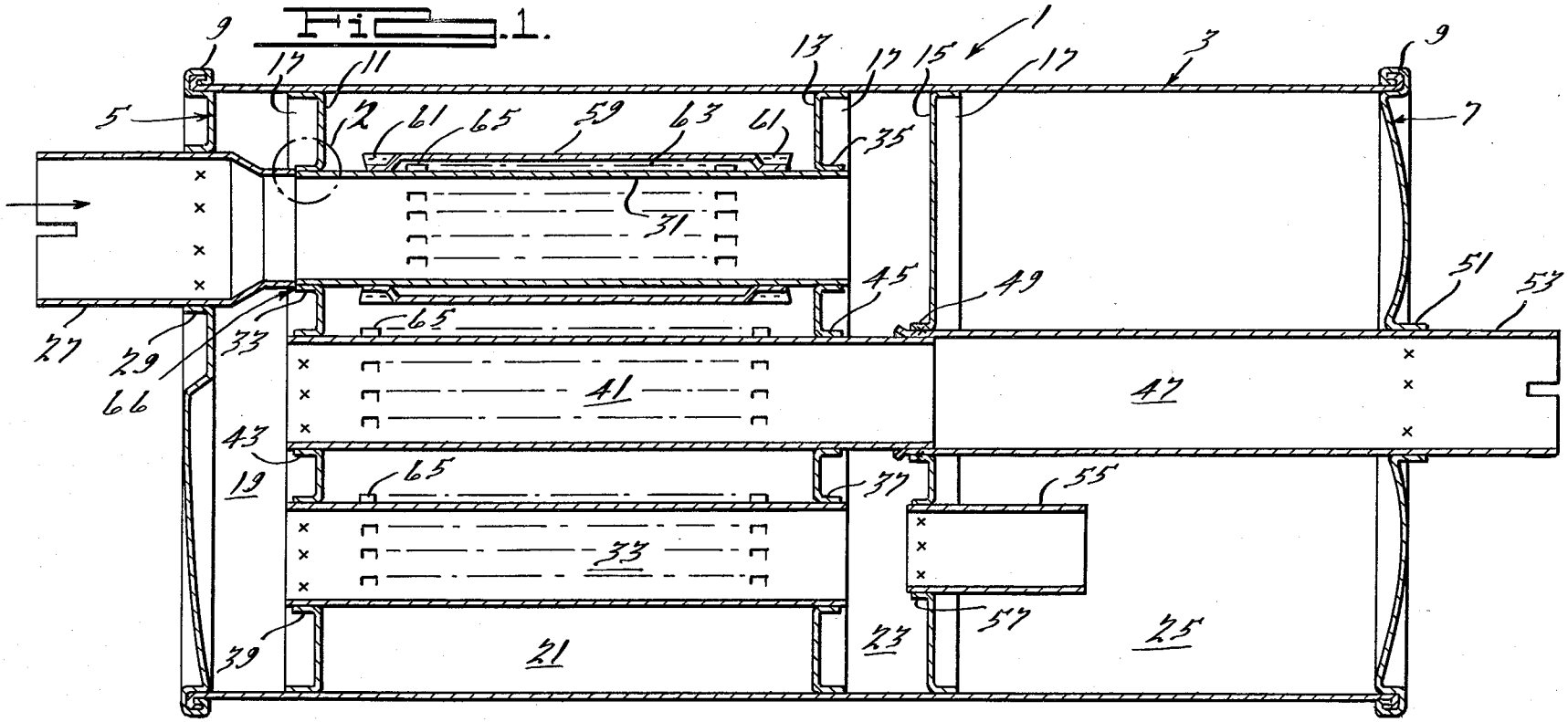
FIG. 1 is a longitudinal cross-section through a sound attenuation accoustic muffler for use in the exhaust system of an automobile or truck having an internal combustion engine and shows a joint constructed in accordance with the principles of the invention.

Throughout the drawings an "x" indicates a spotweld or the equivalent.

DESCRIPTION OF THE INVENTION

The illustrated muffler 1 in which the joint of this invention is used is formed of relatively thin gauge mild sheet steel and has an oval tubular outer shell 3 which is closed at opposite ends by an inlet header 5 and an outlet header 7. The headers may be secured to opposite ends of the shell 3 by means of known interlocked or lockseam type joints 9. Within the interior of the housing defined by the combination of shell 3 and end headers 5 and 7 are three longitudinally separated, transverse partitions 11, 13 and 15 which have circumferential flanges 17 that are spot welded to the shell 3.

The partitions and the headers divide the interior of the muffler into a series of transverse chambers extending across the width of the shell 3. The header 5 and partition 11 define a cross-over and outlet chamber 19; the partition 11 and the partition 13 define an expansion chamber 21; the partition 13 and the partition 15 define an inlet and cross-over chamber 23; and the partition 15 and header 7 define a resonator chamber 25.

In addition to gas flow through cross-over chambers 19 and 23, the gas flow path through the muffler is defined by a series of gas flow tubes. These include an inlet pipe or bushing 27 that fits in an annular neck or collar 29 formed in the inlet header 5. The bushing 27 is sized to internally receive and be clamped or welded to an exhaust gas pipe (not shown) for conducting exhaust gas to the muffler 1 from a combustion engine. Coaxial with the bushing 27 is an inlet louver tube 31, normally of lockseam rather than seamless construction, which press fits within an ansular neck or collar 33 on the partition 11 at its inlet end and within a neck 35 on the partition 13 at its outlet end.

In a similar manner, an intermediate gas flow louver tube 33 has its inlet end fitting within a neck 37 on the partition 13 and its outlet end fitting within a neck 39 in the partition 11. Also, there is an outlet gas flow louver tube 41 that fits within a neck 43 on the partition 11 at its inlet end, the other end of tube 35 extending through and being supported in a neck 45 in the partition 13. A second outlet tube 47 has its inner end supported in a neck 49 in partition 15 and its outer end projected through a neck 51 in the header 7 outside of the shell 3 to serve as an outlet bushing 53 for clamping or welding to the tailpipe (not shown) of the exhaust system.

In addition to the gas flow tubes just described, the muffler 1 has a tuning tube 55 supported in and spot welded to a collar 57 in the partition 15 so that it projects into the resonator chamber 25, the length and diameter of the tube 55 being related to the volume of the chamber 25 in a known way to form a means for attenuating a pre-determined low sound frequency.

The gas flow tubes 31, 41, and 33 are perforated along most of their length within the expansion chamber 21, and as indicated, these perforations are preferably in the form of louvers 65 that are pressed in patches into sheet metal which is then rolled up and lockseamed into tubular form. Sound is attenuated by the louvers as well as by communication of the gas with the chamber 21. A shell 59 is disposed around the perforations in the inlet tube 31 and pinched down at opposite ends as seen at 61 in contact with the tube 31 to form a closed, relatively small volume "spit" chamber 63 around the perforation part of the tube 31 for attenuating high frequency sound and roughness.

The problem of fastening the various tubes in place within the shell 3 is complicated by the large temperature differentials and fluctuations that exist during use of the muffler in an exhaust system. On the one hand, the tubes must be secured in such a manner that they do not come loose and are not noisy, and provide adequate strength against internal pressure and external forces; but, on the other hand, they should not be secured in such a way that joints between parts will be overstressed to the point of fracture by temperature induced loads. In the structure illustrated, this is provided for by use of slip joints between the ends of tubes 31 and 33 and the necks 35 and 37 and the end of tube 41 in the tube 47. As already mentioned, the "x's" in the drawings indicate spotwelds of the tubes to partitions or headers which themselves are either spotwelded or secured by joints 9 to the shell 3.

The improved joint 66 of the present invention is a butt-type joint between the end edge of inlet bushing 27 and the end edges of partition neck 33 and inlet lockseam louver tube 31. Normally these parts will be low carbon sheet steel and it may be coated, as with an aluminum-zinc alloy. Typically, the bushing 27 is about 2.25" O.D. and 0.054" metal thickness; the partition neck 33 is about 2.0" I.D. and 0.033" thick; and the louver tube 31 is about 2.0" O.D. and 0.033" thick.

The metal layer arrangement in this joint can be electric welded on a mass production basis without short circuiting to produce consistent, high quality weld joints uniting all three parts to each other if welded by means of a magnet arc butt welding process. This process is commercially known and is also described in U.S. Pat. Nos. 3,287,539 and 3,882,299 and in West German Pat. No. 2,258,417; though, to our knowledge, it has not been used for a three layer butt joint comparable to joint 66. It involves use of a magnetic field to control an electric arc between parts to be welded, which parts can be stationary to simplify handling.

Apparatus 67 for forming the welded joint 66 is illustrated in FIG. 4 and includes a magnet coil and core means 69 inside a support post 71 which has an annular support and centering shoulder or ledge 72 for the muffler bushing 27, a guide ring 73 also serving to center the bushing 27. The apparatus includes an upper plate 75 with an upraised bed 77 on which the wall of partition 11 is supported. The bed has an outer peripheral surface 79 around which the flange 17 of the partition is fitted to center it. The neck 33 of the partition projects inside of and is spaced from the annular wall defining aperture 81 in the bed.

Figure 2:
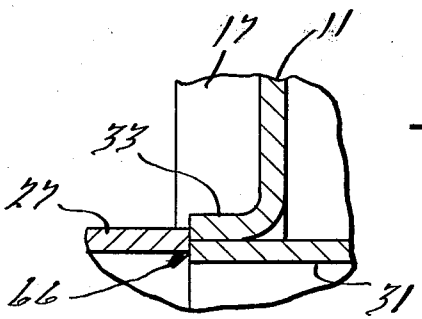
FIG. 2 is an enlarged view of the joint structure within the circle of FIG. 1.

The tube 31 has been coaxially press fitted into partition neck 33 so that the squared ends of the two parts are substantially flush and coplanar. It is important that the squared end of the bushing 27 overlap both the neck 33 and tube 31 as shown in FIG. 2 and the top of FIG. 5 and be coaxial with them and this is insured by the structure of apparatus 67. Suitable means (not shown) may be incorporated in the apparatus for moving the ledge 72 and bed 77 a slight amount relative to each other so that the parts may be axially separated by a suitable gap while the electric arc is produced to initiate heating of the metal end edges (center of FIG. 5) and then moved together to form the butt welded seam or joint 66 (bottom of FIG. 5). The top end of the coil means 69 is a magnet pole block and, as illustrated, it is transversely aligned with the three annular end edges that are to be welded together. The magnet coil and magnet core (not shown) are inside the core structure 69 and therefore inside of bushing 27. The apparatus 67 is of such a nature that it is adapted to automatic or semi-automatic operation. The process is simple and fast, for example about 0.5 sec. weld arc time and 1 sec. stand/anneal time. Force to butt or forge the parts together can be as required, 300 lbs. being used successfully on joints of the type shown herein.

The apparatus 67 and the weld process which takes place in it produces a subassembly of bushing 27 butt welded at its end edge to the end edges of partition neck 33 and lockseam louver tube 31 whose end edges are also welded to each other. In making the muffler 1, the ends of tubes 41 and 33 can be welded to necks 43 and 39 in the partition 11, the partition 13 placed on the ends of tubes 31, 41 and 33, the unit placed inside the shell 3, and the partition flanges 17 welded to the shell. The neck 29 of header 5 can be slipped over the bushing 27 and spotwelded to it, and the interlocked joint 9 pressed in place. When all this is done, the bushing 27 by virtue of welded joint 66 to partition 11 and the welds affixing it to header neck 29 can serve as strut to reinforce the header 5 against excessive distortion or blow-out since loads on the header will be transmitted into the partition 11 and into the shell 3.

Prior structure for accomplishing this is shown in the muffler 101 of FIG. 6, structure of this muffler being given the reference numbers as used for muffler 1 with 100 added. In muffler 101, the end of bushing 127 overlaps the neck 133 as it is extended so that it projects through and beyond neck 133, being spotwelded to the neck. The end of louver tube 131 fits inside the end of the bushing 127. In bushing 27 the overlapping end of bushing 127 is saved at no sacrifice in muffler strength. In fact the weld metal of joint 66 has the distinctive, characteristic, and desirable microstructure produced by magnet arc welding in that the widths of the heat affected metal and weld zone are much less than for high frequency resistance welding, the weld zone microstructure is uniform, homogeneous, and continuous with the base steel microstructure and structural inhomogeneities, such as grain coarsening, oxide inclusion, etc., commonly found in electric resistance welds are absent. Further, as compared with microstructures produced by high frequency electric-resistance welds of low carbon steels, the microstructure of the present joints are free of undesirable, localized martensite in the weld zone since iron carbide decomposition and attendant localized carbon enrichment of adjacent ferrite grains is avoided. Further, the process does not produce agglomeration of second phase carbide particles leading to embrittling or other undesirable grain boundry networks around the base steel ferrite grains in the weld zone microstructure. Thus, the microstructure of the weld zone in joint 66 as produced by magnet arc welding promotes toughness, strengh, and fatigue resistance and is distinguishable from that produced by other weld or fusion processes.

In operation of the muffler 1 as a muffler in an exhaust system, incoming exhaust gas enters through the bushing 27 and passes along the length of the tube 31 into the cross-over chamber 23. It changes direction and flows back toward the inlet end of the muffler through the intermediate louver tube 33. When it leaves this tube it enters the cross-over chamber 19 at the inlet of the muffler and flows from it, after reversing direction, into the louvered outlet tube 41. It then flows into the imperforate outlet tube 47 to bushing section 53 through which it leaves the muffler to enter a tailpipe and flow to atmosphere. Silencing of the objectionable sound frequencies in the gas occurs as it follows this path through the muffler tubes and cross-over chambers due to changes in cross-section of the path, the effects of communication through the louvers 65 with the otherwise closed expansion chamber 21, and communication with the small closed chamber 63. All these serve to remove a wide variety of frequencies and considerable sound energy from the gas. In addition, a predetermined low sound frequency is attenuated by means of the tuning tube 55 and the related resonator chamber 25.

From the standpoint of structural integrity, the partitions 11, 13 and 15 have flanges 17 that are spotwelded to the shell 3 and can transfer force on them into the shell as well as reinforce the shell wall against lateral deflection. The inlet header 5 is reinforced by virtue of the novel welded joint 66 which rigidly connects the end of the bushing 27 to the partition 11, the bushing also being spotwelded to the neck 29 of the header 5. The bushing thus acts as a header reinforcement or bridge even though it does not extend to a plane beyond the back of the partition 11 as has been considered necessary heretofore in production mufflers, this being shown at 166 in FIG. 6. Some breathing within the muffler shell can take place due to the slip fits of tube 31, 41, 33 in the partition 13 and in the inner end of the outlet tube 47. Tube 47, however, does serve as a strut or bridge to reinforce the outlet header 7 by virtue of its spotweld connection with the neck 51 of the header and a spotweld connection with the neck 49 in partition 15. It is apparent by comparing joint 66 with joint 166 that there is a saving in metal by virtue of the joint of this invention. Since mufflers of this type are produced by the millions, this translates into a significant material and weight saving and saving in energy used. As has been indicated above, this is done at no sacrifice in strength; and, in fact, a joint microstructure is produced which is superior to that found in spotwelded joints. Furthermore, the weld in joint 66 extends continuously around the entire interface of the joined parts, i.e., 360°, whereas the normal spot weld connection between the bushing 127 and the neck 133 would be a discontinuous circumferential series of individual spotwelds. Use of the magnetic arc process to fuse the three tubular parts together produces a highly desirable microstructure, relatively low flash, very narrow weld zone, permits use of stationary parts during welding in a relatively simple weld fixture as shown in FIG. 4, and is usable to produce consistent quality welds on a mass production basis utilizing automation or semi-automation.

Modifications may be made in the particular structures and details described without departing from the spirit and scope of the invention. For example, a necked down tube or other part, instead of partition 11, could be welded to two butting, aligned tubes corresponding to tubes 27 and 31.

We claim:

1. An acoustic muffler for hot flowing gases such as combustion engine exhaust gases comprising an outer shell, an internal member having an annular neck, said neck having an annular end edge, a first tube supported inside said neck and having an annular end edge substantially flush and coplanar with the end edge of the neck, a second tube in said muffler substantially coaxial with said neck and first tube and having an annular end edge in abutment with the end edges of both the neck and first tube, said internal member and said first and second tubes being made of low carbon steel, and a weld zone at the interface of said edges uniting each of said ends to each of the other two ends and with said neck and first tube end edges in abutment with the end edge of the second tube, said weld zone having a substantially homogeneous microstructure of the type produced by a magnet arc weld process characterized by substantial freedom from martensite and from embrittling deposits in the grain boundaries of ferrite grains.

2. A muffler as set forth in claim 1 wherein said internal member comprises a transverse partition in said shell, said first and second tubes and said neck being substantially coaxial about an axis normal to said partition.

3. A muffler as set forth in claim 2 wherein said partition extends across the muffler and is welded to the shell.

4. A muffler as set forth in claim 3 including a header at one end of the shell, a neck in said header, said second tube being supported in and welded to said neck whereby said second tube acts as a force transmitting member between said header, weld zone, neck, and partition so that the partition reinforces the header.

5. An acoustic muffler for hot flowing gases such as combustion engine exhaust gases comprising an outer shell, an internal member having an annular neck, said neck having an annular end edge, a first tube supported inside said neck and having an annular end edge substantially flush and coplanar with the end edge of the neck, a second tube in said muffler substantially coaxial with said neck and said first tube and having an annular end edge in abutment with the end edges of both the neck and the first tube, said internal member and said first and second tubes being made of an electrically conductive material and a weld zone at the interface of said edges uniting each of said ends to each of the other two ends and with said neck and first tube end edges in abutment with the end edge of the second tube, said weld zone having a substantially homogeneous microstructure of the type produced by a magnet arc weld process.

* * * * *